US006951480B2

(12) United States Patent
Rivera

(10) Patent No.: US 6,951,480 B2
(45) Date of Patent: Oct. 4, 2005

(54) MOBILE DEVICE BATTERY CHARGER MOUNTING UNIT

(75) Inventor: Walter Rivera, Rancho Santa Margarita, CA (US)

(73) Assignee: Nextel, San Jose, CA (US)

( * ) Notice: Subject to any disclaimer, the term of this patent is extended or adjusted under 35 U.S.C. 154(b) by 118 days.

(21) Appl. No.: 10/752,034

(22) Filed: Jan. 7, 2004

(65) Prior Publication Data

US 2005/0148235 A1 Jul. 7, 2005

(51) Int. Cl.[7] ..... H01R 13/60
(52) U.S. Cl. ..... 439/568; 439/668; 439/529
(58) Field of Search ..... 439/568, 577, 439/529, 668; 320/446; 211/86.01

(56) References Cited

U.S. PATENT DOCUMENTS 5,086,958 A * 2/1992 Nagy ..... 224/544
5,179,590 A * 1/1993 Wang ..... 379/454
5,392,350 A * 2/1995 Swanson ..... 379/446
5,414,770 A * 5/1995 Wang ..... 379/446
5,610,979 A * 3/1997 Yu ..... 379/455
5,687,234 A * 11/1997 Chang ..... 379/454
5,790,661 A * 8/1998 Patterson ..... 379/446
5,839,919 A * 11/1998 Chen ..... 439/529
5,860,824 A * 1/1999 Fan ..... 439/265
5,971,242 A * 10/1999 Schuerman ..... 224/544
6,058,185 A * 5/2000 Alanara ..... 379/446
6,138,041 A * 10/2000 Yahia ..... 455/569.2
6,157,163 A * 12/2000 Blackwood ..... 320/115
6,299,041 B1 * 10/2001 Pitisi et al. ..... 224/271
6,312,284 B1 * 11/2001 Tsay ..... 439/529
6,317,497 B1 * 11/2001 Ou ..... 379/454
6,341,218 B1 * 1/2002 Poplawsky et al. ..... 455/569.1
6,364,184 B1 * 4/2002 Hauck et al. ..... 224/271
6,366,672 B1 * 4/2002 Tsay ..... 379/446
6,478,276 B1 * 11/2002 Louh ..... 248/309.1
6,478,628 B1 * 11/2002 Ming ..... 439/668
6,480,378 B2 * 11/2002 Chang ..... 361/686
6,551,142 B2 * 4/2003 Eisenbraun ..... 439/668
6,616,470 B2 * 9/2003 Lu et al. ..... 439/265
6,687,513 B1 * 2/2004 Hsu Li ..... 455/557
6,762,585 B2 * 7/2004 Liao ..... 320/107

* cited by examiner

*Primary Examiner*—Ross Gushi
(74) *Attorney, Agent, or Firm*—Arent Fox, PLLC

(57) ABSTRACT

Cellular telephone mounting unit for a vehicular battery charger that supports and retains a cellular telephone onto a vehicle battery charger while the cellular telephone battery is charging. One variation of the mounting unit includes a semi-circular member having an arcuate surface, and a curved perimeter. The member including a notched portion formed in the arcuate surface so that a detachable attachment on the cellular telephone can be docked therein. The detachable attachment piece includes a supporting member and a fastening member. The fastening member including a head and a body rotatably connected thereto to allow the cellular telephone to pivot in the mounting unit.

13 Claims, 3 Drawing Sheets

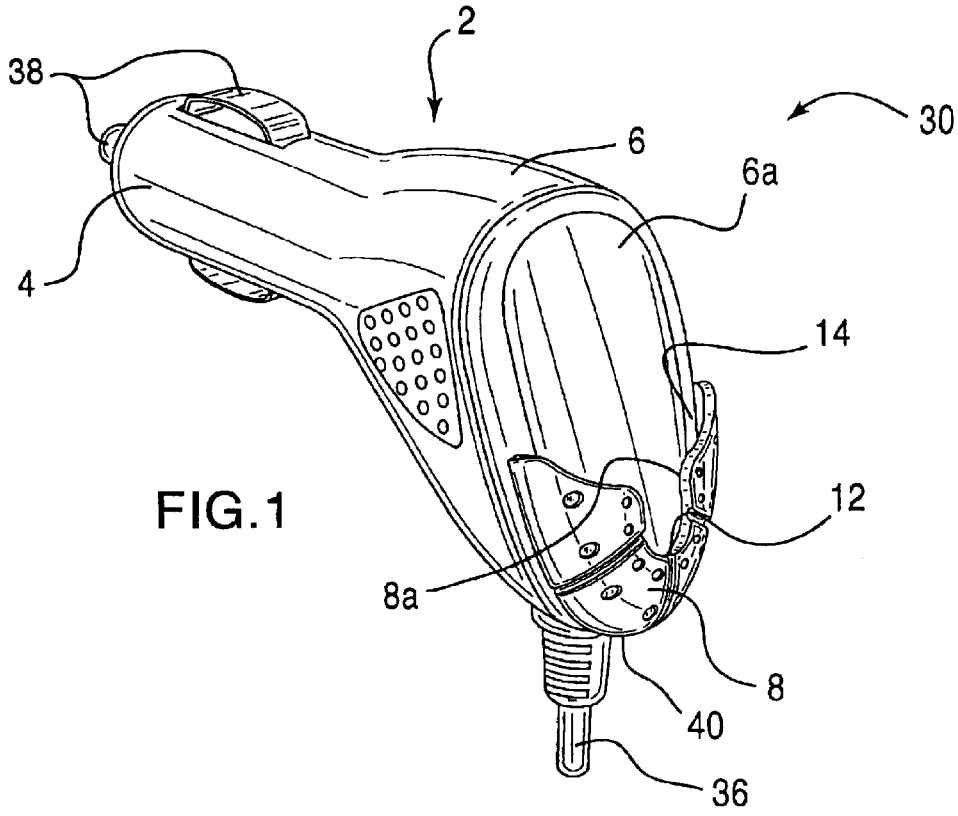
FIG.1
FIG.2
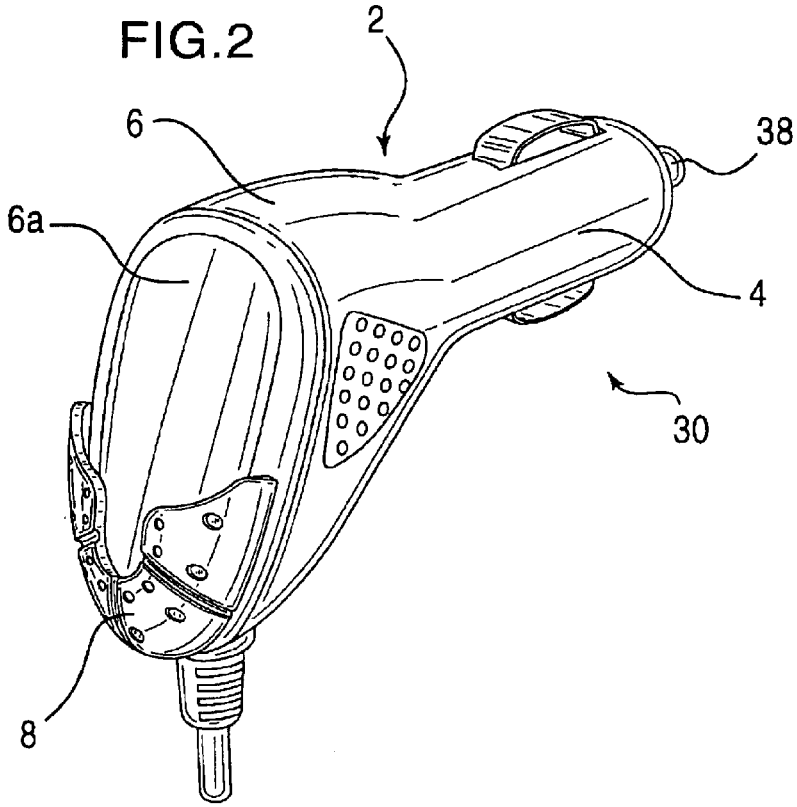

MOBILE DEVICE BATTERY CHARGER MOUNTING UNIT

BACKGROUND OF THE INVENTION

1. Field of the Invention

This invention relates to a cellular telephone mounting unit and complementary features for a telephone. More specifically, the present invention relates to a cellular telephone mounting unit for a vehicular battery charger so that the telephone is readily accessible to a driver or other user.

2. Description of the Related Art

Cellular telephone use has grown tremendously in a short period of time. The cellular telephone has a significant usage outside of the home or business where traditional landline telephones still predominate. As a result, a significant percentage of cellular telephones are used in and around automobiles and other vehicles. Consistent use or even extended non-use of the cellular telephone naturally drains the cellular telephone battery. Thus, charging the battery can be necessary at any time, especially in the vehicle. However, the existing arrangement for charging a battery in a vehicle, especially a moving vehicle if the telephone is also to be used, can be hazardous.

The typical vehicular battery charger has one end that is inserted into a power supply, and another end that has an extendable cord connected to the cellular telephone battery. In this arrangement, the cellular telephone is not restrained in the normal operation of a vehicle and therefore, can freely swing from the end of the cord. Specifically, the vehicular battery charging cord of existing chargers is long enough so that an individual can talk on the telephone while it is charging, but the charging cord is also long enough so that it can slide to different areas of the vehicle passenger compartment and not be accessible to the driver, or other vehicle occupants who seek to make or answer a call. As a result, the cellular telephone, when charging could be anywhere in the vehicle passenger compartment. For example, the telephone could be wedged between the driver's seat and the armrest, between the passenger's seat and the armrest or, underneath the passenger's seat or driver's seat. The cellular telephone can also be on the driver's floor, for example, under the brake pedal, or on the floor in front the passenger's seat, where it is difficult to reach when the vehicle is stationary and unsafe to reach when the vehicle is in motion. As such, the driver or other user would have to take his or her eyes off of the road in order to pick up the cellular telephone.

The cellular telephone in such an arrangement creates a hazard inside the vehicle passenger compartment when the vehicle is in motion. In particular, a hazard exists when the telephone rings, and the driver naturally has the urge to answer the telephone and must search for it in the vehicle passenger compartment because the telephone has moved away from the driver's immediate view. The free movement of the cellular telephone in the vehicle passenger compartment can also result in physical damage to the telephone. Thus, it is necessary to support and secure the cellular telephone in the vehicle passenger compartment in a manner that allows the driver or other user to have easy access to the cellular telephone. Therefore, there is a need for an improved method and device for securing and supporting a cellular telephone to a vehicular battery charger.

SUMMARY OF THE INVENTION

The present invention relates to a vehicular battery charger mounting unit for mounting a mobile communication device, such as a cellular telephone, having complementary features for such mounting while the battery is charging. Among other things, the vehicular battery charger mounting unit allows a driver or other user in the vehicle to access a cellular telephone, while it is charging, in a more safe and convenient manner.

The vehicular battery charger for mounting a mobile communication device includes a charging member having a charging end and a mounting end. The charging end is connected to a power supply that charges the battery. The mounting end of the charging member has a mounting unit secured thereto. The mounting end can also have a charging cord, one end of which is connected to the battery and through which power is supplied to the battery or telephone. In one embodiment of the present invention, the mounting unit can have an arcuate surface extending toward the vehicle passenger compartment. The mounting unit also has a notched portion that acts as a holster or cradle for an attachment piece of the cellular telephone. The attachment piece connects the cellular telephone to the mounting unit. The notched portion of the mounting unit can be a U-shaped notch that facilitates the connection of the attachment piece.

In embodiment, the attachment piece is detachable from the cellular telephone and can be installed, for example only, when the driver or other user wants to charge the cellular telephone. In one embodiment, the attachment piece includes a supporting member and a fastening member. The supporting member can be partially recessed within at least one surface of the cellular telephone and meshed with the surface of the cellular telephone. The fastening member of this embodiment has a head portion and a body portion and optionally can be rotatably connected to the supporting member.

In an embodiment of the present invention, a system of mounting a cellular telephone onto a vehicular battery charger includes a mounting unit at one end of the charger. The mounting unit includes a notched portion for receiving the detachable attachment piece. The attachment piece can optionally be snap-fit or otherwise detachably attached to the cellular telephone, to secure the piece onto the cellular telephone. The detachable attachment piece can be made from a resin material and includes a fastening member and a supporting member. In operation, once the detachable attachment piece is secured to the cellular telephone, the telephone can be docked into the notched portion of the mounting unit, thereby removably attaching the cellular telephone to the mounting unit.

The mounting unit can be a semi-circular member having an arcuate surface and a curved perimeter. The semi-circular member has a notched portion formed in the arcuate surface. The notched portion has an open end at the curved perimeter and extends radially to a closed end proximal to the central portion of the member.

The mounting unit can also be rectangular, pentagonal, and more complex shapes, and can include the notched portion for retaining the cellular telephone. Further, the mounting unit can have a flat profile or an arcuate profile. Many different materials known in the art can be used in the production of the mounting unit. For example, hard plastics and other resins can form the entire unit.

An additional feature of the present invention is that the mounting unit serves to physically protect the cellular telephone so that when a passenger or driver enters the vehicle, neither one has to move the telephone from the vehicle seats to comfortably sit down. Also, as a result of the present invention, the vehicle occupants are is less likely to inadvertently sit or step on the telephone, possibly causing damage to the telephone.

Additional advantages and novel features of the invention are set forth in the attachments to this summary, and in part will become more apparent to those skilled in the art upon examination of the following or upon learning by practice of the invention.

BRIEF DESCRIPTION OF THE DRAWINGS

The features of the invention will be more readily understood with reference to the following description and the attached drawings, wherein:

FIG. 1 illustrates a left perspective view of an example mounting unit in accordance with the present invention;

FIG. 2 illustrates a right perspective view of an example mounting unit for use in accordance with the present invention;

DETAILED DESCRIPTION OF THE INVENTION

The present invention is directed to a vehicular battery charger for charging a mobile communication device battery, such as a cellular telephone battery in an automobile. The vehicular battery charger of the present invention can be used to mount the cellular telephone thereon, so as to prevent the telephone, while charging, from being tossed about the vehicle passenger compartment when the vehicle is in motion. Further, the present invention prevents the charging cellular telephone from being misplaced in the vehicle even while the vehicle is parked. The stabilization of the cellular telephone acts as a safety and convenience feature, in that, while the cellular telephone is charging, it is readily visible and easily accessible, primarily to the driver, but also to passengers.

Figure 3:
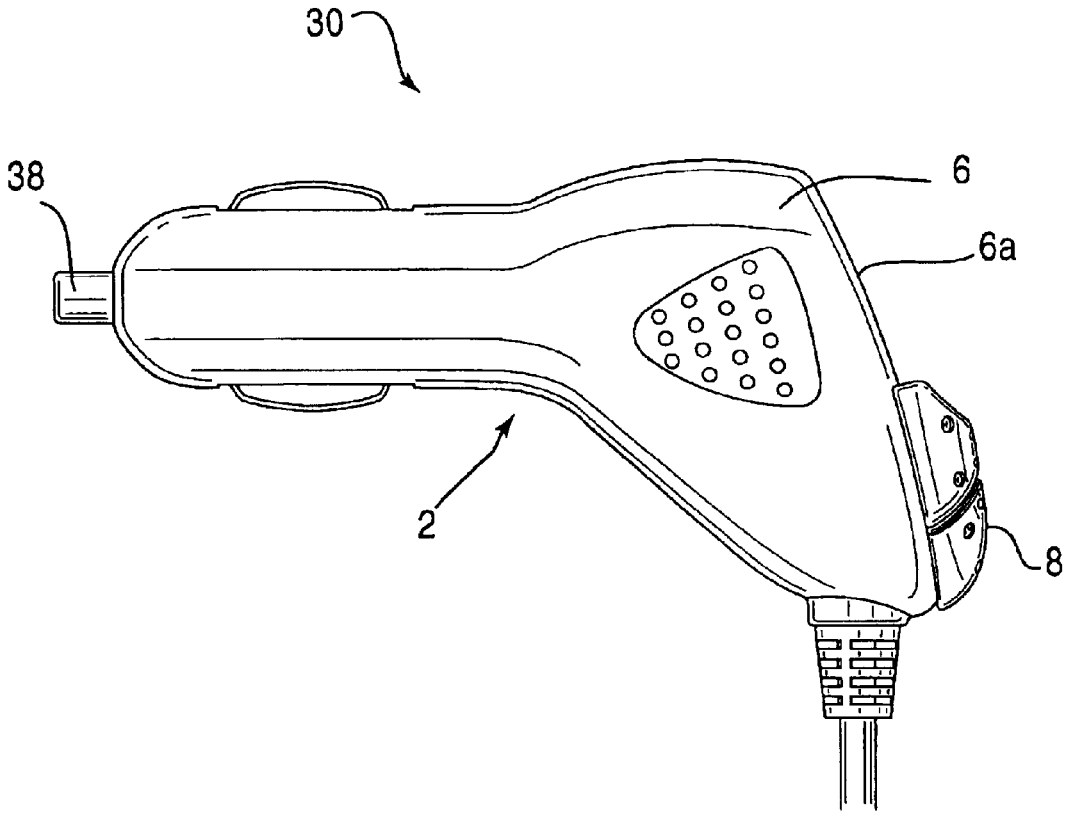
FIG. 3 illustrates a side view of an example mounting unit for use in accordance with the present invention.
Figure 4:
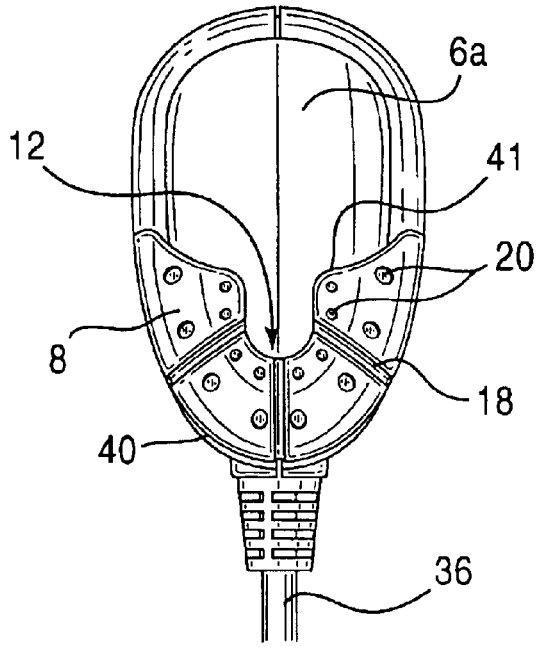
FIG. 4 illustrates front view of an example mounting unit in accordance with the present invention.

As shown in the perspective views of FIGS. 1 and 2 and also FIGS. 3 and 4, a vehicular battery charger 30 for mounting a mobile communication device, such as a cellular telephone, includes a charging member 2 having a first end or charging end 4 and an axially opposite second end or mounting end 6. The charging end 4 includes one or more contact elements 38 that are operatively connected to a power supply (not shown) in the vehicle. The power supply can be a cigarette lighter, or other 12-volt power supply that receives power from a power source, such as, for example, the vehicle battery, or other charging source. The charging member 2 also has a charging cord 36 that is insertable into the cellular telephone battery, and through which the cellular battery is charged. Most automobiles include a cigarette lighter or 12-volt, or other power supply on, for example, the dashboard, so that they can be readily accessed without the driver or other user taking an eye off of the road. As such, the mounting end 6 of the charging member 2 projects out from the dashboard toward the driver, making the mounting end 6 easily visible and accessible to the driver. Mounting the cellular telephone to the mounting end 6 of the charging member 2 allows the cellular telephone to remain within view of the driver.

The cellular telephone remains within view of the driver by being attached via the mounting unit 8 of the present invention. The body of the mounting unit 8 acts as a holster or cradle for the cellular telephone so that the driver or other user can readily see and easily access the cellular telephone within the vehicle passenger compartment. The mounting unit 8 can be secured to the mounting end 6 of the charging member 2, so that the front of the cellular telephone faces the driver.

The mounting unit 8, in one embodiment of the present invention, can be a semi-circular member having an arcuate surface, with a curved perimeter 40. The mounting unit 8 can have at least one arcuate surface that extends in an axial direction away from the mounting end 6 toward the vehicle passenger compartment. The arcuate surface provides, for example, a smooth appearance relative to the mounting unit 8.

The arcuate outer surface can be, for example, convex or have a combination of convex and concave portions and project away from the mounting end face 6*a* of the charging member 2, so as to create a gap 14 between the mounting end face 6*a* and the inner face 8*a* of the mounting unit 8. The perimeter of the mounting unit can also follow the curvature or contour of the mounting end face 6*a* of the charging member 2. The perimeter 40 of the mounting unit 8 can be secured to the mounting end face.

In the embodiment shown in FIGS. 1 and 2, a notched portion 12 is formed in the mounting unit 8. The notched portion 12 can extend in a radial direction from the perimeter 40 of the mounting unit 8 toward a center of the unit. The notched portion 12 can be located in a central portion of the mounting unit 8 so that the weight of the cellular telephone 32, when mounted thereon, can be evenly distributed on the unit. As illustrated in particular in FIG. 4, one side 41 of the curved perimeter 40 can taper toward the notched portion to provide a guide for a detachable attachment piece, discussed below, to attach the cellular telephone to the mounting unit 8.

The notched portion 12 of the mounting unit can be U-shaped, as shown, for example, in FIG. 4, or any shape that is compatible with the external shape of the body portion of the fastening member for the telephone or other mounted device. The arcuate surface can also follow a contour of the cellular telephone to present a streamlined look as shown in FIG. 3.

In one embodiment of the present invention, the mounting unit 8 can be secured to the mounting end 6 of the charging member 2 by any method of fastening including but not limited to glue or other adhesives, screws, or other fastening features known in the art.

As shown in FIG. 4, for example, the arcuate surface of the mounting unit 8 may also include other features for convenience or aesthetic purposes, such as a plurality of grooves and dimples on the outer surface.

Figure 5:
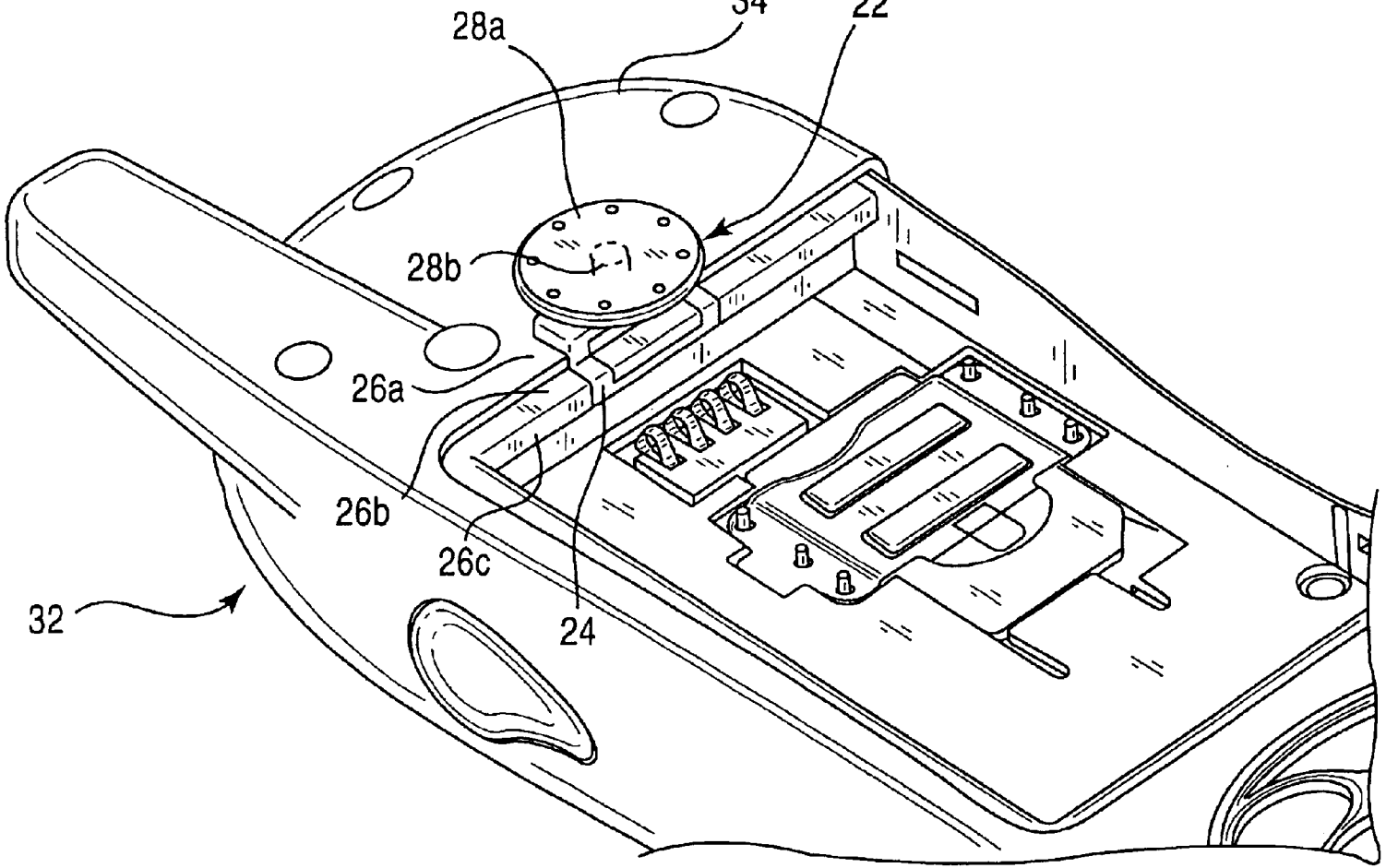
FIG. 5 illustrates a perspective view of an example detachable attachment piece in accordance with the present invention.

The present invention also includes a system of mounting a cellular telephone to the mounting unit. As shown in FIG. 5, the detachable attachment piece 22 is designed to fit into the mounting unit and mount the cellular telephone 32 onto the mounting unit 8 shown in FIGS. 1–4. In one embodiment, the detachable attachment piece includes a supporting member 24 that attaches to an opening or a rear panel 34 of the mobile communication device, and a fastening member 28*a*, 28*b* that attaches to the mounting unit 8 shown in FIGS. 1–4. Both the supporting member 24 and other features of the attachment piece 22 can be formed from any of a number of materials known in the art, such as metal, hard plastic, or resin materials. The supporting member can be partially recessed within the surfaces of the rear panel 34.

In FIG. 5, the cellular telephone battery has been removed for illustrative purposes, revealing the frame 26*a*, 26*b*, 26*c* the rear panel 34. The supporting member 24 can follow the contour of the frame 26*a*, 26*b*, 26*c*. As illustrated in FIG. 5, the supporting member 24 has, for example, a stepped profile that matches the contour of the frame. However, the supporting member is not limited to a stepped profile, but can have any configuration that is compatible with the frame, so that when the battery is attached to the cellular telephone, the detachable attachment piece 22 is securely fitted in the frame and does not obstruct the battery attachment.

Also, in the embodiment shown in FIG. 5, the supporting member 24 can mesh with the rear panel 34 of the cellular telephone 32 so that the supporting member 24 is flush with the surfaces of the rear panel 34 of the telephone 32. As illustrated in FIG. 5, for example, the stepped portion of the supporting member 24 is flush with and partially projects from the rear panel 34 of the cellular telephone.

In the embodiment of FIG. 5, the detachable attachment piece 22 includes a head portion 28*a* and a body portion 28*b* (also referred to herein collectively as a "fastening member"). Although the head portion 28*a* is shown as circular in cross section in FIG. 5, the head portion can have any appropriate shape. Further, the body portion 28*b* although illustrated as cylindrical, can have any of a variety of shapes. The head portion 28*a* can also be larger than the body portion 28*b* to allow retention in the mounting unit 8 of FIGS. 1–4. The attachment piece 22 can be optionally rotatably connected to the supporting member 24, so that the detachable attachment piece 22 is pivotable in the notched portion 12 of the mounting unit 8, as shown in FIGS. 1–4.

In an example embodiment of the present invention, a system of mounting a cellular telephone onto a vehicular battery charger having a mounting unit at one end thereof provides a secure and convenient feature for charging a battery in the vehicle. The system includes a detachable attachment piece 22 snap-ft onto the cellular telephone. As discussed above, the detachable attachment piece includes a fastening member, having a head portion and a body portion; and a supporting member 24. The detachable attachment piece attached to the rear panel of a cellular telephone can be docked in the notched portion 12 of the mounting unit 8, of FIGS. 1–4, where it can be held until the driver or other user is ready to use the telephone. Docking the detachable attachment piece involves inserting the head portion 28*a* into the gap 14 between the mounting unit 8 and the vehicular battery charger 30 and sliding the body portion 28*b* within the notched portion 12 of the mounting unit 8 of FIGS. 1–4. The perimeter of the semi-circular member that forms the mounting unit, in one example of the present invention, is tapered toward the notch, so that the tapered surface can guide the detachable attachment piece 22 to the notched portion without the driver or other user taking an eye off of the road.

Example embodiments of the present invention have now been described in accordance with the above advantages. It will be appreciated that these examples are merely illustrative of the invention. Many variations and modifications will be apparent to those skilled in the art.

I claim:

1. A vehicular battery charger mounting unit for mounting a mobile communication device, comprising:

a mounting body secured to a charging member, the mounting body having an arcuate surface projecting away from the charging member, and a notched portion therein, the notched portion extending radially from a perimeter of the mounting body.

2. The vehicular battery charger mounting unit according to claim 1, wherein a gap is formed between the charging member and an inner surface of the mounting body.

3. The vehicular battery charger mounting unit according to claim 1, wherein the mounting body comprises a shape that follows a contour of the charging member.

4. The vehicular battery charger mounting unit according to claim 1, wherein the notched portion is disposed cent rally in the mounting body.

5. The vehicular battery charger mounting unit according to claim 1, wherein the notched portion has a curved opening.

6. The vehicular battery charger mounting unit according to claim 1, wherein the mounting body is secured to the charging member by an adhesive.

7. The vehicular battery charger mounting unit according to claim 1, wherein the arcuate surface comprises a plurality of grooves and dimples.

8. A method of mounting a mobile communication device onto a vehicular battery charger having a mounting unit at one end thereof, the mounting unit including a notched portion, the method comprising:

fitting a detachable attachment piece to the mobile communication device, the detachable attachment piece including a fastening member and a supporting member, the fastening member having a head portion and a body portion; and docking the detachable attachment piece into the notched portion of the mounting unit.

9. The method of mounting a mobile communication device onto a vehicular battery charger according to claim 8, wherein docking the detachable attachment piece includes:

inserting an edge of the head portion into a gap between an inner surface of the mounting unit and the vehicular battery charger; and sliding the body portion within the notched portion.

10. The method of mounting a mobile communication device onto a vehicular battery charger according to claim 8, wherein snap-fitting includes:

recessing a portion of the supporting member within a surface of the mobile communication device.

11. A system of mounting a mobile communication device to a vehicular battery charger comprising:

an attachment to the mobile communication device; and a mounting unit attached to a vehicular battery charging member.

12. The system according to claim 11, wherein the attachment includes a supporting member and a fastening member, the fastening member being rotatably attached to the supporting member.

13. The system according to claim 12, wherein the supporting member is mounted to a rear panel of the mobile communication device.

* * * * *